United States Patent [19]

Miyata et al.

[11] Patent Number: 5,001,437

[45] Date of Patent: Mar. 19, 1991

[54] ELECTRON STORAGE RING

[75] Inventors: Kenji Miyata; Masatsugu Nishi, both of Katsuta; Shunji Kakiuchi, Hitachi, all of Japan

[73] Assignee: Hitachi, Ltd., Tokyo, Japan

[21] Appl. No.: 371,031

[22] Filed: Jun. 26, 1989

[30] Foreign Application Priority Data

Jun. 29, 1988 [JP] Japan ..... 63-159168

[51] Int. Cl.[5] ..... H05H 13/02

[52] U.S. Cl. ..... 328/235; 328/237

[58] Field of Search ..... 328/228, 230, 233, 235, 328/237

[56] References Cited

U.S. PATENT DOCUMENTS 3,303,426 2/1967 Beth ..... 328/235

4,849,705 7/1989 Takayama ..... 328/237 X

*Primary Examiner*—Kenneth Wieder

*Attorney, Agent, or Firm*—Antonelli, Terry, Stout & Kraus

[57] ABSTRACT

An electron storage ring has bending magnets, quadrupole magnets, and sextupole magnets arranged in a ring for constraining a beam of electrons along a path. When the beam is injected, a control means controls a power source for the magnet so that the beam has a high equilibrium emittance. This gives the beam a large dynamic aperture, simplifying beam injection. Once the beam has been injected, the field strengths of the magnets are varied to cause a reduction in the emittance to a low value, at which the beam is stored. Synchrotron radiation is generated which has a high brightness because the low emittance means the beam has a small diameter. During the reduction in equilibrium emittance, the betatron oscillation frequency is maintained on a stable operation region and the chromaticity is maintained substantially zero.

26 Claims, 4 Drawing Sheets

$\epsilon_0$ : THEORECTICAL LIMIT VALUE OF EMITTANCE

ELECTRON STORAGE RING

BACKGROUND OF THE INVENTION

1. Field of the Invention

The present invention relates to an electron storage ring, which may, for example, form part of an apparatus for generating synchrotron radiation.

2. Description of the prior art

It is known to generate synchrotron radiation using an electron storage ring. As shown in FIG. 1 of the accompanying drawings, electrons are generated and accelerated by a linear accelerator 100 and fed to a syncrotron 101 where they are further accelerated. After suitable acceleration, the electrons, which now form a beam, are fed to an electron storage ring 102. That ring comprises a plurality of bending magnets 1, a plurality of quadrupole magnets 2, and may further include sextupole magnets 3. The electron storage ring 102 stores the beam of electrons, and the deflection of the beam at the bending magnets 1 generates synchrotron radiation which is passed down suitable conduits 103 to e.g. an inspection site 104.

Depending on the energy of the beam, which is partially affected by the size of the system, the synchrotron radiation may be used for many different functions. At relatively low energies, the beam may be used in, for example, the manufacture of semiconductor devices, while at higher energies, the main applications are in materials science.

FIG. 2 of the accompanying drawings shows a detail of part of the electron storage ring 102 of FIG. 1, and illustrates the relative locations of the deflection magnets 1, the quadrupole magnets 2, and the sextupole magnets 3. FIG. 2 also shows a radio-frequency acceleration cavity 10 which is used to accelerate further the beam, which passes in an equilibrium orbit 20.

One key parameter of the synchrotron radiation generated from the electron storage ring is its brightness. (intensity). In order to maximize this, it is desirable for the beam to be as concentrated as possible, i.e. its transverse dimensions should be as small as possible. These dimensions are determined by what is known in the art as the "emittance" of the beam, with beam size being proportional to the square root of the emittance.

The emittance of the beam in the electron storage ring is determined by the equilibrium relationship between the excitation of the radiation and radiation damping of betatron oscillations (oscillations centering round an equilibrium orbit in a direction perpendicular to the orbital axis of the beam), which damping ocurrs upon generation of synchrotron radiation. For a given electron beam energy, the emittance depends on the physical arrangement of the magnets forming the storage ring, but also on their excitation magnitudes which determine their field strength.

If the storage ring is constructed only of deflection magnets (which deflect the orbit around the ring) and quadrupole magnets, (which converge the beam orbit in the horizontal and vertical direction) then there are only double-pole and quadrupole components in the magnetic fields affecting the beam. The equation defining the betatron oscillations of the electron beam then becomes linear, and the beam is stable provided that there is an oscillation solution for the beam. If electron collisions are neglected (which collisions may occur due to e.g. dust or other material in the beam duct), the linearity of the equation is approximately maintained even when the amplitude of the beta oscillations is considerably larger than the beam duct, so that the beam is stable around the ring. Thus, it is possible to say that the dynamic aperture of the stable region of the beam is considerably larger than the physical aperture of the beam duct in which the beam passes.

However, with only deflection magnets and quadrupole magnets, the energy-dependency (chromaticity) of the beta oscillation frequency may depart from a substantially zero value, in which case the betatron oscillation frequency exhibits energy-dependency. In this case, the beam undergoes a head-tail instability due to lateral electron magnetic forces caused by electromagnetic fields (wake fields) which occur due to the electron magnetic interaction between a group of electrodes and a vacuum conductor wall. As a result, heavy beam losses can arise. With only deflection and quadrupole magnets, the chromaticity assumes a positive or negative value (always negative in large-size rings) and this is undesirable.

Therefore, in order to make the chromaticity substantially zero, sextupole magnets are provided at the places where the energy dispersion function is large. Thus, a head-tail instability can be avoided, but there is a side effect, namely that the dynamic aperture is reduced. The reason for this is that the sextupole magnetic field components give rise to an amplitude-dependency in the betatron oscillation frequency. Thus, if the amplitude becomes large, the betatron oscillations undergo a thirdorder resonance, and at still larger amplitudes stable oscillation solutions disappear.

Therefore, in order to increase the brightness of the beam, the chromaticity correction required becomes larger, and therefore stronger sextupole fields are needed. However, this has the effect of reducing the dynamic aperture of the beam.

There is, however, a practical problem with reduction in the dynamic apperture of the beam. When a packet of electrons is injected into a ring already containing a beam, the procedure of injection is as follows. Suppose that an electron beam is already stored in the storage ring 102, and it is wanted to add energy (i.e. more electrons) to that beam. Those electrons are accelerated by the linear accelerator 100, further accelerated by the synchrotron 101, and then transferred to the storage ring. Use is made of a septum magnet which deflects the injected electrons into a path substantially parallel to the main beam, which main beam is itself displaced towards the septum magnet. Subsequently, both the main beam and the newly injected electrons are moved sideways, in a direction so that the main beam moves away, from the septum to a position in which the newly injected electrons are within the septum, and also within the dynamic aperture of the beam. In this position the newly injected electrons and the beam will merge.

However, it can be appreciated that this process depends on the dynamic aperture of the beam being sufficient to include both the main beam and the newly injected electrons when the beam is moved sideways. Thus, the dynamic aperture must have a minimum radius in the direction that the beam is moved which is given by the sum of half the stored beam size, the effective thickness of the septum, and full size of the beam of new electrons to be injected. This is the minimum since errors and operational inefficiencies must be allowed for.

Therefore, if the dynamic aperture of the beam is too small, injection of new electrons becomes difficult or impossible.

Therefore, the dynamic aperture must be maintained sufficiently large to permit injection, which leads to increased emittance, and hence to increased beam size which limits the brightness of the synchrotron radiation.

Attempts have been made to solve this problem, but none have proved wholly successful. It is known from, for example "IEEE Particle Accelerator Conference Number 1 (1987) pp 443–445" to enlarge the dynamic aperture with the emittance maintained low, and to provide further sextupole magnets, in addition to those for correcting chromaticity, at positions where the energy dispersion function is zero.

This has the problem that the number of harmonic sextupole magnets are magnets are increased, and that the gain in dynamic aperture is small so that the corresponding gain in brightness is not great.

It is also known to make use of two storage rings, the beam being built up to a predetermined amount in one ring, at a high emittance, with the beam then being transfered to a low emittance storage ring by a one-turn on axis injection. In this way, the dynamic aperture of the second storage ring may be small, so that the emittance is low. Such a proposal is discussed in "Nuclear Instruments and Methods in Physical Research A246 (1986), pp 4–11". This method has, however, the grave disadvantage that two electron storage rings are needed, which increase the cost of the system significantly.

SUMMARY OF THE PRESENT INVENTION

The present invention seeks to provide an electron storage ring in which high brightness can be achieved. In order to do this, the present invention proposes that, during beam injection, the field strengths of the magnets are adjusted so that the beam has a high equilibrium emittance and, after beam injection, the field strengths of the magnets are changed to thereby shift the equilibrium emittance of the beam to a low value.

During beam injection, any synchrotron radiation generated is not used, and hence there is no need for a low emittance. It is more important during injection to maintain a large dynamic aperture, and therefore the energy dispersion function (being the deviation of a closed orbit attributed to a linear approximation when the ratio of the distortion of momentum $p/p = 1$ is true) is made larger by suitable selection of the field strengths of magnets (primarily the quadrupole magnets). Since the energy dispersion function is large, the field strengths of the sextupole magnets for correcting chromaticity can be reduced. Thus, the nonlinear components of the magnetic fields decrease, and the dynamic aperture is increased. As a result, the emittance is increased.

After the beam has been injected, the beam is shifted to a low-emittance state, while maitaining the stability of the beam. As a result, the beam size is reduced, increasing the briallance of the beam.

Thus, the present invention may be defined as an arrangement in which the dynamic aperture of the beam is reduced, or in which the transverse size of the beam is reduced.

Normally, during this reduction in equilibrium emittance, other variations are necessary. As was mentioned earlier, it is important that the betatron oscillation frequency is such as to maintain the beam in a stable operation region, and this may be achieved by maintaining the betatron oscillation frequency substantially constant during the variation in equilibrium emittance. This may be achieved by varying the quadrupole magnets. Furthermore, the chromaticity of the beam should be maintained to a substantially zero value, which may be achieved by adjusting at least some of the sextupole magnets.

In practice, what normally happens is for the strength of the magnetic field of at least one of the quadrupole magnets to be increased by e.g. at least 5%. Then, at least two of the other two quadrupole magnets have their field strengths varied to maintain the beta oscillation frequency substantially constant, or at least in a stable operation region, and the sextupole magnets are varied to control the chromaticity.

The present invention should be distinguished from the case where, during setting up of the storage ring, the ring has an extremely high equilibrium emittance. During setup, the energy dispersion function is wholly suppressed, which is not the case during normal operation of the beam.

The control of the magnets is normally by a suitable control means, which may be e.g. computer controlled.

BRIEF DESCRIPTION OF THE DRAWINGS

An embodiment of the invention will now be described in detail by way of example, with reference to the accompanying drawings in which.

DETAILED DESCRIPTION

Figure 1:
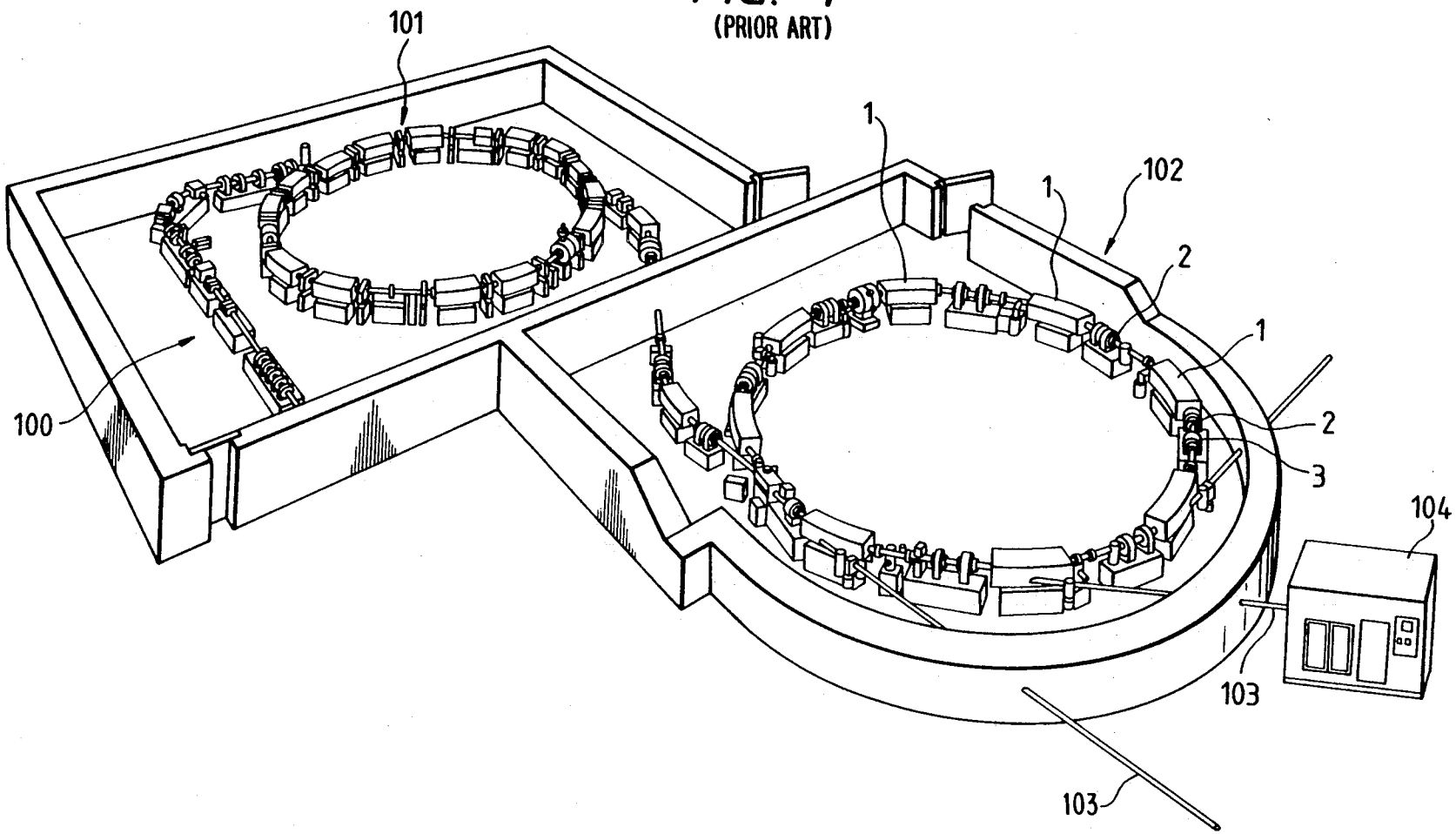
FIG. 1 (PRIOR ART)
FIG. 1 shows a general view of an electron beam generating system, and has already been described.
Figure 2:
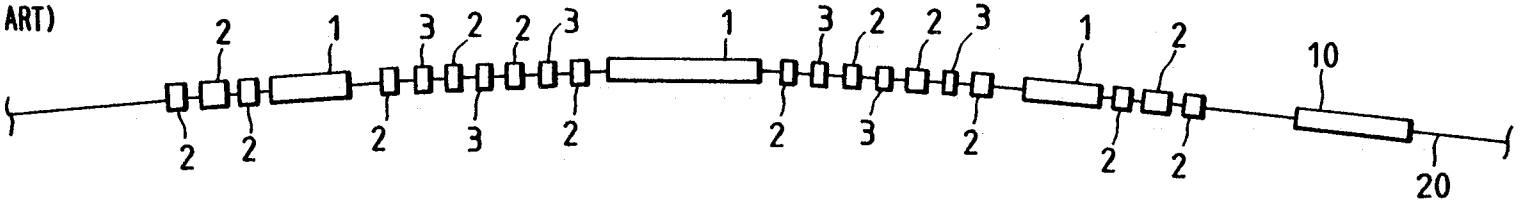
FIG. 2 (PRIOR ART)
FIG. 2 shows the details of the magnets of FIG. 1.
Figure 3:
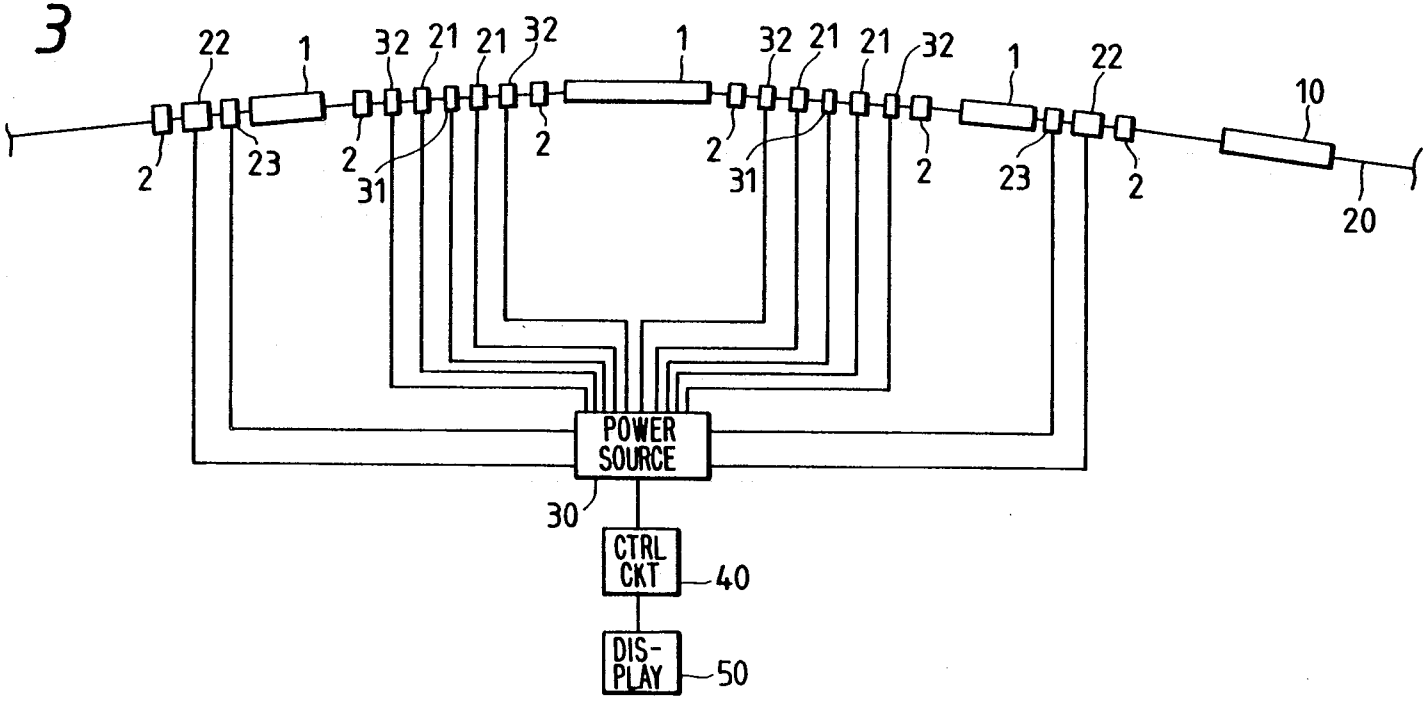
FIG. 3 shows the magnetic arrangement in a system according to the present invention.

Referring to FIG 3, an electron storage ring comprises a plurality of magnets including bending magnets 1, quadrupole magnets 2, 21, 22 and 23, and sextupole magnets 3, 31, and 32, The beam is constrained to move along a beam path 20 and is accelerated by, for example, a radio-frequency accelerating cavity 10 which compensates for energy loss due to synchrotron radiation of the beam. The rest of the system for generating the beam may be the same as shown in FIG. 1.

The quadrupole magnets 21, 22, 23 and the sextupole magnets 31, 32 have their magnetic field strength determined by a power source 30, which power source 30 is controlled by a control circuit 40. That control circuit may generate an output to a suitable display 50 on which the magnetic field strengths may be displayed. The control circuit 40 includes a memory in which a control program may be stored to control the magnets.

In this embodiment, the excitation magnitudes of groups of three quadrupole magnets 21, 22, 23 and groups of two sextupole magnets 31, 32 are controlled by the control circuit 30. The controlled variation in the field strength of the quadrupole magnets 21. 22. 23 are set to control the emittance, the betatron oscillations in the horizontal direction, and the betatron oscillations in the vertical direction. The field strengths of the sextupole magnets 31, 32 are set in order to control the horizontal and vertical chromaticities of the beam.

Figure 4:
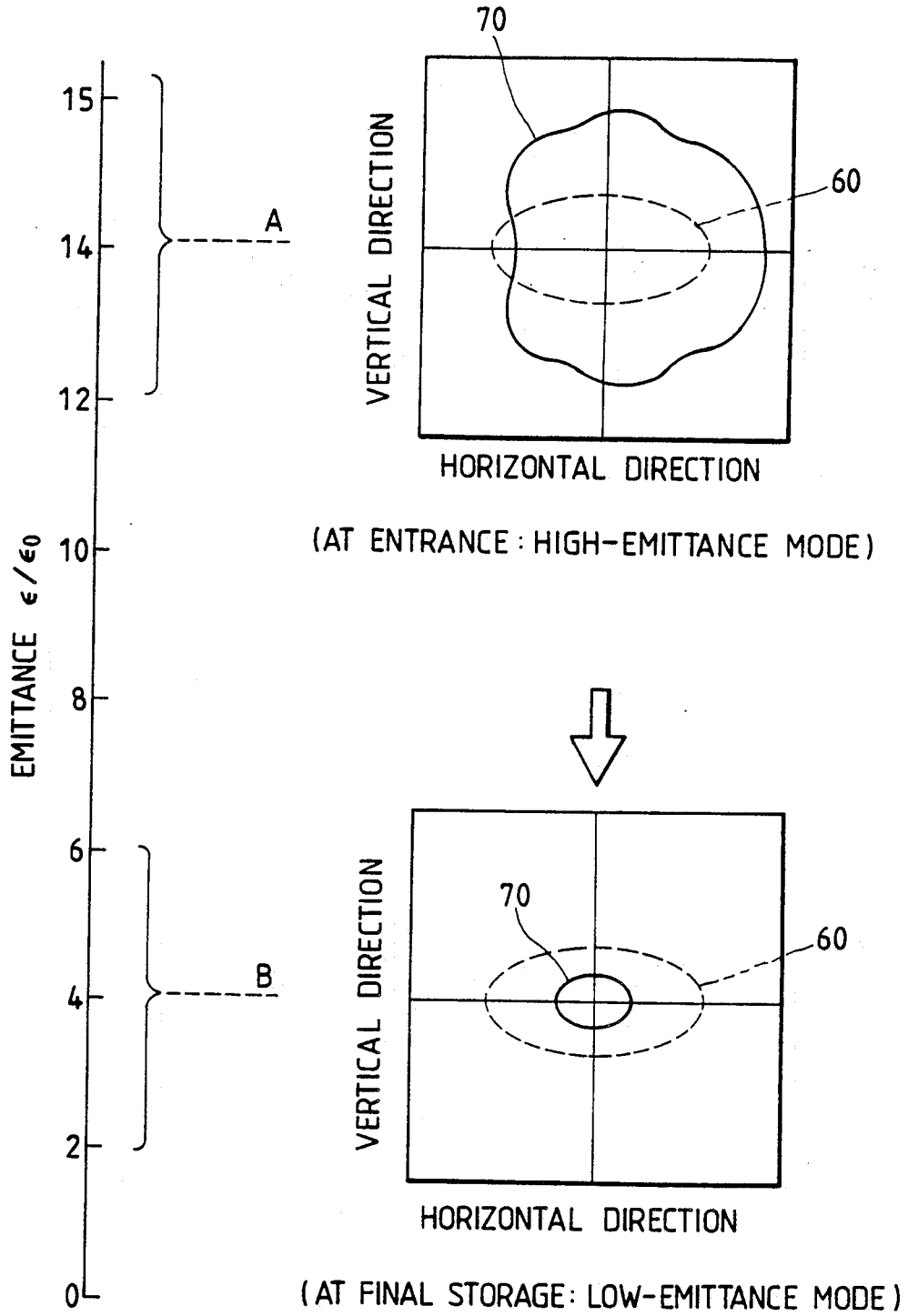
FIG. 4 illustrates the relationships between the emittance and the dynamic apperture in the present invention.

Referring now to FIG. 4, the upper part of this figure shown at A corresponds to the case where the beam is injected. The quadrupole magnets 21, 22, 23 and the sextupole magnets 32 are adjusted so that the dynammic aperture 70 is larger than the size of the beam duct 60 in which the beam 20 is passing. In this state, trial beam injection occurs to correct for any distortions in the closed orbit, and then full beam injection ocurrs in the high-emittance mode.

After the beam injection has ocurred, the field strengths of the quadrupole magnets 21, 22, 23 and the sextupole magnets 31, 32 are gradually changed and the equilibrium emittance of the beam is reduced to a low value, in which the beam is stored, with the beam being maintained in a stable condition during this reduction. FIG. 4 shows at B the state of low equilibrium emittance, in which the dynamic aperture 70 of the beam is much less than the physical dimensions of the beam duct 60. In practice, the reduction in dynamic apperture is by a factor of 3 to 4.

Figure 5:
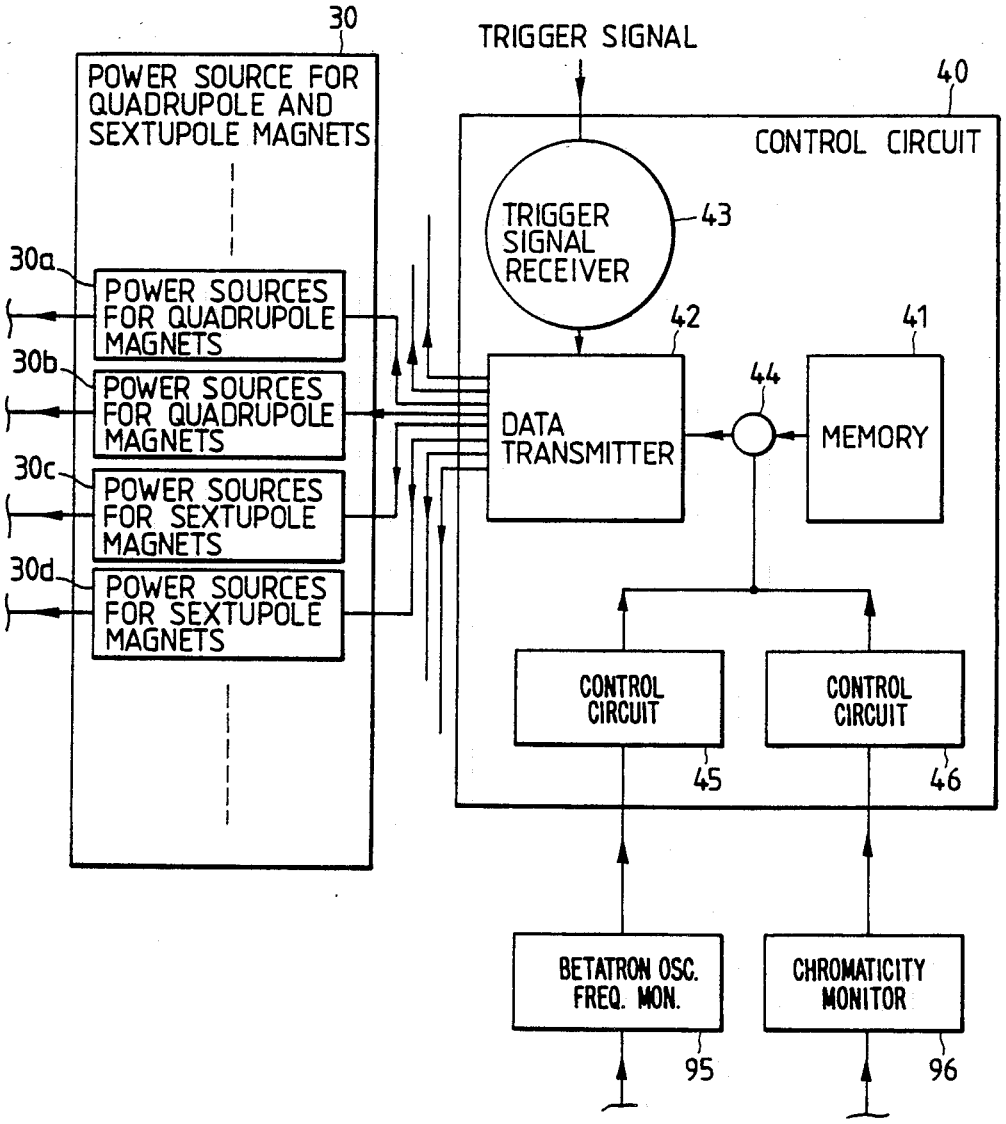
FIG. 5 is a block diagram of the control circuit for use in the present invention.

The control circuit 40 is shown in more detail in FIG. 5. The control circuit 40 has a memory 41 which stores therein predetermined time-variation patterns of magnetic field strengths, which are analysed in the data transmitter 42, and transmits signals indicating the appropriate magnetic field strengths to the power source 30 of the magnets. As illustrated in FIG. 5, the power source 30 may comprise a plurality of sub-sources 30*a* to 30*d* for controlling each magnet. Also illustrated in FIG. 5 is a trigger signal receiver 43 which controls the timing of the data transmission from the data transmitter 42 to the control circuit 30.

The first stage in the control is to increase the field strengths of one of the three quadrupole magnets 21, of each group 21, 22, 23 to vary the equilibrium emittance and then to detect any variation in betatron oscillation frequency using a betatron oscillation frequency monitor 95, and also to detect the chromaticity using a chromaticity monitor 96. The betatron oscillation frequency monitor 95 and the chromaticity monitor 96 generates data which is fed via respective control circuits 45, 46 to signal switch 44, and hence via the data transmitter 42 to control the other quadrupole magnets and the sextupole magnets. In this way, the betatron oscillation frequency can be controlled to a predetermined value, and the chromaticity can be maintained zero, or at least at a very low value. Thus, by using the control circuit 40, the field strengths for the quadrupole magnets, 21, 22, 23 and the sextupole magnets 31, 32 in FIG. 3 are subject to a programmed control based on a feedback arrangement.

As was described previously the display 50 may display the changes in the magnetic field strengths.

Thus, the present, invention may permit satisfactory beam injection, while having a storage mode with a small dynamic aperture with the emittance during that storage mode therefore being lowered by, for example, one half or more as compared with the prior art. The electron beam can be injected at high emittance with a sufficiently large dynamic aperture to make beam injection easy.

What is claimed is:

1. An electron storage ring comprising a plurality of magnets arranged in a ring for constraining a beam of electrons, and control means for controlling said magnets, said control means being arranged to control said magnets so as to cause a variation in the magnetic fields of said magnets, which variation reduces the equilibrium emittance of the beam from a high value to a low value.

2. An electron storage ring according to claim 1, wherein said control means includes means for varying the magnetic field of one of said magnets, and for automatically varying the magnetic field of at least another of said magnets in dependence on parameters of said electron beam.

3. An electron storage ring according to claim 2, having means for detecting a betatron oscillation frequency of said electron beam, and said means for automatically varying the magnetic field of said at least another of said magnets is arranged to vary the magnetic fields of said at least another of said magnets on the basis of said betatron oscillation frequency.

4. An electron storage ring according to claim 3, wherein said means, for automatically varying the magnetic field of said at least another of said magnets is arranged to maintain said betatron oscillation frequency so as to be restricted to a stable region.

5. An electron storage ring according to claim 4 wherein said one of said magnets is a quadrupole magnet and said at least another of other magnets is a quadrupole magnet.

6. An electron storage ring according to claim 2, having means for detecting the chromaticity of said beam, and said means for automatically varying the magnetic field of said at least another of said magnets is arranged to vary the magnetic fields of said at least another of said magnets on the basis of said chromaticity.

7. An electron storage ring according to claim 6, wherein said means for automatically varying the magnetic field of said at least another of said magnets is arranged to maintain said chromaticity to a substantially zero value.

8. An electron storage ring according to claim 7, wherein said one magnet is a quadrupole magnet, and said at least another of said magnets is a sextupole magnet.

9. An electron storage ring comprising a plurality of magnets arranged in a ring for constraining a beam of electrons, and control means for controlling said magnets, said control means being arranged to control said magnets so as to cause a variation in the magnetic fields of said magnets, which variation reduces the dynamic aperture of the beam.

10. An electron storage ring comprising a plurality of magnets arranged in a ring for constraining a beam of electron, and control means for controlling said magnets, said control means being arranged to control said magnets so as to cause a variation in the magnetic fields of said magnets, which variation reduces the transverse size of the beam from a high value to a low value.

11. An electron storage ring comprising a plurality of magnets arranged in a ring for constraining a beam of electrons, and control means for controlling said magnets, said control means being arranged to define a first operation in which said beam has a high equilibrium emittance and an unsuppressed energy dispersion function, and a second operation state in which said beam has a low equilibrium emittance and a partially suppressed energy dispersion function.

12. An electron storage ring comprising a plurality of magents arranged in a ring for constraining a beam of electrons, and control means for controlling said magnets, said control means being arranged to define a beam storage operation including a first stage for injecting an electron beam into said ring, said beam having a high equilibrium emittance, a second stage for reducing said equilibrium emittance of said beam, and a third stage in which said beam has a low equilibrium emittance.

13. An electron storage ring comprising a plurality of bending magnets, a plurality of quadrupole magnets, and a plurality of sextupole magnets, said bending magnets, said quadrupole magnets and said sextupole magnets defining a path for an electron beam, and a control means for controlling said quadrupole magnets so as to cause an increase in the strength of the magnetic field of at least one of said quadrupole magnets, and a variation in the strength of the magnetic field of at least two others of said quadrupole magnets, thereby to change the equilibrium emittance of the beam without causing a substantial change in a betatron oscillation frequency of the beam.

14. An electron storage ring according to claim 13, wherein said control means has means for controlling automatically said at least two others of said quadrupole magnets on the basis of said controlling of said one of said quadrupole magents.

15. An electron storage ring comprising a plurality of bending magnets, a plurality of quadrupole magnets, and a plurality of sextupole magnets, said bending magnets, said quadrupole magnets and said sextupole magnets defining a path for an electron beam, and a control means for controlling said quadrupole magnets so as to cause an increase in the strength of the magnetic field of at least one of said quadrupole magnets, and a change in the field strengths of the magnetic fields of at least two of said sextupole magnets, thereby to reduce the equilibrium emittance value of the beam and to maintain the chromaticity of the beam approximately zero.

16. An electron storage ring according to claim 15, wherein said control means has means for controlling automatically said sextupole magnets on the basis of said controlling of said one of said quadrupole magnets.

17. An electron storage ring comprising a plurality of bending magnets, a plurality of quadrupole magnets, and a plurality of sextupole magnets, said bending magnets, said quadrupole magnets and said sextupole magnets defining a path for an electron beam, and a control means for controlling said quadrupole magnets so as to cause an increase in the magnetic strength of the field of one of said quadrupole magnets by at least 5%, thereby to reduce the equilibrium emittance value of the beam from a high value to a low value.

18. An electron storage ring comprising a plurality of magnets arranged in a ring for constraining a beam of electrons, injection means for injecting electrons into said ring to form said beam, and a control means for controlling said magnets and said injection means, said control means having a memory containing a control program for activating said injection means to inject electrons into said ring and for subsequently causing the magnetic fields of said magnets to change thereby to reduce the equilibrium emittance value of the beam from the corresponding value during injection of the electrons forming said beam.

19. A method of operating an electron storage ring having a plurality of magnets arranged in a ring, said method comprising:

injecting a beam of electrons into said ring, said beam having a high equilibrium emittance; and controlling the magnetic field of said magnets so as to vary the equilibrium emittance of said beam from said high equilibrium emittance to a low equilibrium emittance.

20. A method according to claim 19, wherein the magnetic field of at least one of said magnets is increased by at least 5%.

21. A control system for an electron storage ring, said control system having means for controlling magnets of said ring, said control means being arranged to control said magnets so as to cause a variation in the magnetic fields of said magnets, which variation reduces the equilibrium emittance of the beam from a high value to a low value.

22. A control system according to claim 21, having a memory for storing data requesting said variation.

23. A control system according to claim 22, having power control means for controlling power supplied to said magnets by said control system.

24. A control system for an electron storage ring having a plurality of magnets for constraining an electron beam, comprising a display for displaying the magnetic field strength of at least one of the magnets of the ring, and means for controlling the display so as to display a variation in the magnetic fields of said magnets, which variation reduces the equilibrium emittance of the beam from a high value to a low value.

25. A synchrotron radiation generating apparatus, including an electron storage ring, said electron storage ring comprising a plurality of magnets arranged in a ring for constraining a beam of electrons, and control means for controlling said magnets, said control means being arranged to control said magnets so as to cause a variation in the magnetic fields of said magnets, which variation reduces the equilibrium emittance of the beam from a high value to a low value.

26. An apparatus comprising an electron storage ring, said electron storage ring comprising a plurality of magents arranged in a ring for constraining a beam of electrons, and control means for controlling said magnets, said control means being arranged to control said magnets so as to cause a variation in the magnetic fields of said magnets, which variation reduce the equilibrium emittance of the beam from a high value to a low value.

* * * * *